US009638443B2

(12) United States Patent
Shimazu et al.

(10) Patent No.: US 9,638,443 B2
(45) Date of Patent: May 2, 2017

(54) AIR-CONDITIONING APPARATUS

(75) Inventors: Yusuke Shimazu, Tokyo (JP); Yoshihiro Sumida, Tokyo (JP); Koji Azuma, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 735 days.

(21) Appl. No.: 14/119,011

(22) PCT Filed: Jun. 14, 2011

(86) PCT No.: PCT/JP2011/003387

§ 371 (c)(1),
(2), (4) Date: Nov. 20, 2013

(87) PCT Pub. No.: WO2012/172599

PCT Pub. Date: Dec. 20, 2012

(65) Prior Publication Data

US 2014/0083126 A1 Mar. 27, 2014

(51) Int. Cl.
*F25B 30/02* (2006.01)
*F25B 41/06* (2006.01)
(Continued)

(52) U.S. Cl.
CPC ..... *F25B 30/02* (2013.01); *F25B 13/00* (2013.01); *F25B 41/06* (2013.01); *F25B 49/00* (2013.01);
(Continued)

(58) Field of Classification Search
CPC ..... F25B 41/06; F25B 2313/006; F25B 2313/0293; F25B 2400/0411;
(Continued)

(56) References Cited

U.S. PATENT DOCUMENTS 4,381,651 A * 5/1983 Kubo ..... F25B 41/06 62/296
5,875,651 A * 3/1999 Hill ..... F25B 41/06 138/44
(Continued)

FOREIGN PATENT DOCUMENTS

CN 201886685 U * 6/2011
IT EP 0722667 A1 * 7/1996 ..... A23G 9/04
(Continued)

OTHER PUBLICATIONS

International Search Report of the International Searching Authority mailed Sep. 13, 2011 for the corresponding international application No. PCT/JP2011/003387 (and English translation).
(Continued)

*Primary Examiner* — Allana Lewin Bidder
*Assistant Examiner* — Zachary R Anderegg
(74) *Attorney, Agent, or Firm* — Posz Law Group, PLC

(57) ABSTRACT

An air-conditioning apparatus is capable of suppressing refrigerant flow noise regardless the refrigerant state of an inlet of an expansion mechanism. In parallel to a flow control valve, an opening and closing valve that opens and closes a refrigerant passage and an expansion mechanism having porous bodies capable of passing a refrigerant therethrough are connected in series with each other. In a heating mode, in the case where a controller stops an operation of one or more of a plurality of indoor units and causes the other indoor unit(s) to operate, the flow control valve of the stopped indoor unit is fully closed and the opening and closing valve of the stopped indoor unit is opened.

12 Claims, 4 Drawing Sheets

(51) Int. Cl.
*F25B 49/00* (2006.01)
*F25B 13/00* (2006.01)

(52) U.S. Cl.
CPC . *F25B 2313/006* (2013.01); *F25B 2313/0233* (2013.01); *F25B 2313/0293* (2013.01); *F25B 2341/06* (2013.01); *F25B 2341/0661* (2013.01); *F25B 2400/0411* (2013.01); *F25B 2500/12* (2013.01); *F25B 2600/2513* (2013.01); *F25B 2600/2519* (2013.01)

(58) Field of Classification Search
CPC F25B 2500/12; F25B 2313/0233; F25B 5/02; F25B 2313/0232; F25B 2313/0234; F25B 41/062
USPC ..... 62/159, 160, 200, 296
See application file for complete search history.

(56) References Cited

U.S. PATENT DOCUMENTS

| | | | | |
|---|---|---|---|---|
| 2003/0074914 | A1* | 4/2003 | Hirakanu | F25B 13/00 62/324.6 |
| 2003/0230096 | A1* | 12/2003 | Hwang | F25B 13/00 62/160 |
| 2004/0020221 | A1* | 2/2004 | Flynn | C09K 5/045 62/156 |
| 2004/0035133 | A1* | 2/2004 | Park | F25B 13/00 62/324.1 |
| 2007/0137225 | A1* | 6/2007 | Shindo | F24F 3/065 62/160 |
| 2008/0092572 | A1* | 4/2008 | Kim | F25B 13/00 62/160 |
| 2009/0019871 | A1* | 1/2009 | Yukimoto | F25B 41/062 62/222 |
| 2009/0183520 | A1* | 7/2009 | Yukimoto | F25B 41/062 62/222 |
| 2010/0101256 | A1* | 4/2010 | Kawano | F25B 13/00 62/324.6 |

FOREIGN PATENT DOCUMENTS

| | | | | |
|---|---|---|---|---|
| JP | EP 0653595 | A2 * | 5/1995 | F24F 3/065 |
| JP | 07-310962 | A | 11/1995 | |
| JP | 08-233379 | A | 9/1996 | |
| JP | 11-141961 | A | 5/1999 | |
| JP | 2000-346495 | A | 12/2000 | |
| JP | 3428516 | B2 | 12/2000 | |
| JP | 2002-061879 | A | 2/2002 | |
| JP | 2002-286300 | A | 10/2002 | |

OTHER PUBLICATIONS

Office Action mailed Jul. 1,2014 issued in corresponding JP patent application No. 2013-520302 (and English translation).
Extended European Search Report dated Jan. 28, 2015 issued in corresponding EP patent application No. 11867760.8.
Office Action dated May 19, 2016 issued in corresponding CN patent application No. 201180071605.4 (and English translation).
EP Communication pursuant to Article 94(3) EPC issued Oct. 28, 2016 in the corresponding EP application No. 11867760.8.
Chinese Office Action dated Dec. 2, 2016 issued in corresponding CN patent application No. 201180071605.4 (and English translation).

* cited by examiner

AIR-CONDITIONING APPARATUS

CROSS REFERENCE TO RELATED APPLICATIONS

This application is a U.S. national stage application of International Application No. PCT/JP2011/003387 filed on Jun. 14, 2011.

TECHNICAL FIELD

The present invention relates to an air-conditioning apparatus which decreases refrigerant flow noise of two-phase gas-liquid refrigerant.

BACKGROUND ART

For air-conditioning apparatuses, especially those including multiple indoor units for the purpose of air-conditioning for buildings, hotels, and the like, expansion mechanisms are arranged on the indoor units for refrigerant distribution. Such air-conditioning apparatuses easily produce refrigerant flow noise. Especially when indoor load is small, the rotation speed of an indoor fan in the indoor unit is slow. Thus, fan motor or wind noise is relatively small, and in contrast the refrigerant flow noise is the relatively main factor of noise. Since refrigerant flow noise is in a high frequency band and occurs discontinuously, there is a problem that the noise is easy to audibly recognize, therefore significantly destroying the comfortability of the room.

Regarding existing air-conditioning apparatuses, an air-conditioning apparatus is disclosed, for example, which includes a capillary tube arranged in parallel to a variable expansion mechanism, thus preventing excessive refrigerant flow caused by precision unevenness of the expansion mechanism when in small flow quantity and decreasing the occurrence of refrigerant noise (see Patent Literature 1).

Furthermore, for example, using porous transmitting materials for the internal structure of an expansion mechanism to prevent the occurrence of refrigerant flow noise and to decrease noise is disclosed (see, for example, Patent Literature 2).

Furthermore, for example, delaying the decline timing of rotation speed of the indoor fan when an indoor unit is turned off and thus avoiding noise from being audibly recognized even when refrigerant noise is present is disclosed (see, for example, Patent Literature 3).

CITATION LIST

Patent Literature

Patent Literature 1: Japanese Unexamined Patent Application Publication No. 7-310962 (Paragraph [0033], FIG. 1)

Patent Literature 2: Japanese Unexamined Patent Application Publication No. 2000-346495 (Paragraph [0082], FIG. 7 and FIG. 8)

Patent Literature 3: Japanese Unexamined Patent Application Publication No. 11-141961 (Paragraph [0022])

SUMMARY OF INVENTION

Technical Problem

In the technique described in Patent Literature 1, in the case where the refrigerant flows in small quantity, the flow amount is controlled by the capillary, therefore the refrigerant flow noise resulting from the precision unevenness of the expansion mechanism can be suppressed. However, in the case where the refrigerant status of an inlet of the capillary tube is in two-phase, a gas phase and a liquid phase will reciprocally flow into the capillary tube, therefore resulting in occurrence of refrigerant flow noise, thus causing a problem.

In the technique described in Patent Literature 2, not only in the case where the refrigerant flow noise is the main factor of noise of the indoor unit such as when the indoor unit is stopped or is in low load operation, but also in the case where the refrigerant flow noise is not the main factor of noise of the indoor unit such as when the indoor unit is at the rated load or peak load, the refrigerant passes through a porous transmitting material (hereinafter, will also be stated as porous body) within the expansion mechanism. Although the porous body has an advantage of suppressing the refrigerant flow noise, there is also a disadvantage that the flow resistance is large when the refrigerant passes through the porous body. Therefore, there is a problem in that in order to exhibit sufficiently small flow resistance for the rated load or peak load, it is necessary to increase the size of the expansion mechanism, and thus space and cost saving cannot be realized.

Furthermore, the porous body has a large number of small holes and thus has a function of capturing foreign substances. Therefore, if refrigerant always passes through the porous body, chances of the porous body capturing foreign substances incrementally increase along with elapsing of the operating time. There is a problem in that when the porous body captures a large quantity of foreign substance, the refrigerant cannot be rectified, thus the refrigerant flow noise cannot be controlled, or the flow resistance may increase, thus passing of an adequate flow amount of the refrigerant cannot be achieved for the rated load or peak load. Consequently, the refrigerant flow passage may get clogged, resulting in damage of the equipment.

In the technique described in Patent Literature 3, by gradually ending the operation of the indoor fan when stopping the indoor unit, the refrigerant flow noise is relatively suppressed. However, in the case where, when a user felt that the room is too cold or too hot, the user may operate the indoor unit to stop. This is a problem that when the operation of the indoor fan is gradually stopped, cool or warm wind continues to blow out from the indoor unit, and the user may feel this uncomfortable. Furthermore, there is a problem of increasing power consumption due to the gradual ending of the operation of the indoor fan.

The present invention is made in order to solve the above mentioned problems, and obtains an air-conditioning apparatus which can suppress refrigerant flow noise regardless of the refrigerant state of an inlet of an expansion mechanism.

Furthermore, the present invention obtains an air-conditioning apparatus capable of ensuring long-term reliability while dealing with large flow amount.

Moreover, the present invention obtains an air-conditioning apparatus that can suppress refrigerant flow noise without deteriorating the comfortability of the room.

Solution to Problem

An air-conditioning apparatus for controlling operations of a plurality of indoor units according to the present invention includes a refrigerant circuit including an outdoor unit having a compressor and an outdoor heat exchanger, and a plurality of indoor units each having an expansion valve capable of varying an opening degree and an indoor heat exchanger, the refrigerant circuit connecting the outdoor unit and the plurality of indoor units with refrigerant pipes; a controller configured to control operations of the compressor, the expansion valve, and an indoor fan provided in each of the indoor units; an opening and closing valve configured to open and close a refrigerant passage; and an expansion mechanism having porous bodies capable of passing a refrigerant therethrough. The opening and closing valve and the expansion mechanism are connected in series. In a heating mode in which the refrigerant of high-temperature from the compressor is supplied to the indoor heat exchanger, in a case where the controller stops an operation of at least one of the plurality of indoor units and causes remaining at least one of the indoor units to operate, the controller fully closes the expansion valve and opens the opening and closing valve of the stopped indoor unit, respectively.

Advantageous Effects of Invention

The present invention can suppress refrigerant flow noise regardless of the refrigerant state of an expansion valve inlet.

DESCRIPTION OF EMBODIMENTS

Embodiment 1

Figure 1:
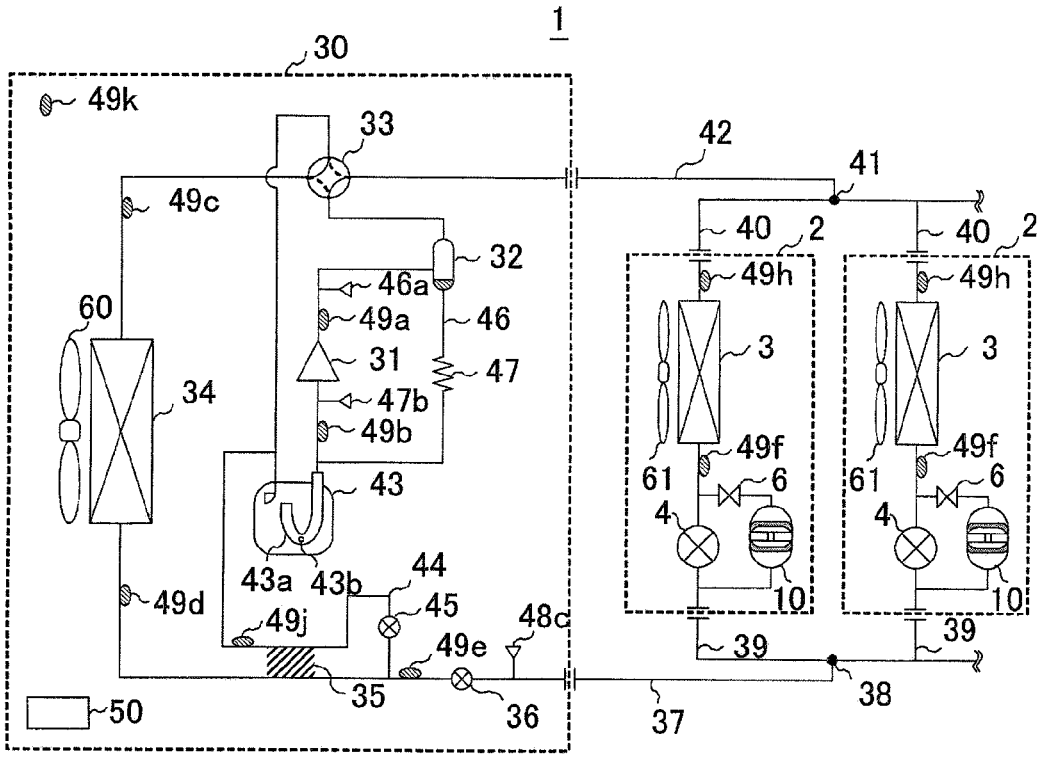
FIG. 1 is a refrigerant circuit diagram of an air-conditioning apparatus according to Embodiment 1.

FIG. 1 is a refrigerant circuit diagram of an air-conditioning apparatus according to Embodiment 1.

Referring to FIG. 1, an air-conditioning apparatus 1 includes an outdoor unit 30 and a plurality of indoor units 2. Reference numeral 42 denotes a gas main pipe connected to the outdoor unit 30. Reference numeral 40 denotes gas branch pipes connected to the indoor units 2. Reference numeral 41 denotes a connection point of the gas main pipe 42 and the gas branch pipes 40. Reference numeral 37 denotes a liquid main pipe connected to the outdoor unit 30. Reference numeral 39 denotes liquid branch pipes connected to the indoor units 2. Reference numeral 38 denotes a connection point of the liquid main pipe 37 and the liquid branch pipes 39.

The indoor units 2 each include an indoor heat exchanger 3, a flow control valve 4, an opening and closing valve 6, and an expansion mechanism 10. The indoor heat exchanger 3 and the flow control valve 4 are connected together in the order from the gas branch pipe 40 to the liquid branch pipe 39 that are connected to the indoor unit 2. The expansion mechanism 10 is connected in parallel to the flow control valve 4. The opening and closing valve 6 is connected in series with the expansion mechanism 10. The expansion mechanism 10 sets flow resistance in accordance with the amount of flow in the indoor unit 2 when load is low. An indoor fan 61 is arranged near the indoor heat exchanger 3. The flow control valve 4 corresponds to an "expansion valve" in the present invention.

The outdoor unit 30 includes a compressor 31. An oil separator 32, a four-way valve 33 serving as a flow switching valve, an outdoor heat exchanger 34, a subcooling heat exchanger 35, and an outdoor flow control valve 36 are sequentially connected, by pipes, on the discharge side of the compressor 31. The outdoor flow control valve 36 is connected to the liquid main pipe 37. An accumulator 43 and the four-way valve 33 are sequentially connected, by pipes, on the suction side of the compressor 31. The four-way valve 33 is connected to the gas main pipe 42. An outdoor fan 60 is arranged near the outdoor heat exchanger 34.

Reference numeral 44 denotes a subcooling bypass path. The subcooling bypass path 44 branches at a point between the subcooling heat exchanger 35 and the liquid main pipe 37, and is merged into a pipe which connects the accumulator 43 and the four-way valve 33 together. Reference numeral 45 denotes a subcooling regulating valve. The subcooling regulating valve 45 and the subcooling heat exchanger 35 are sequentially connected to the subcooling bypass path 44.

The accumulator 43 includes a U-shaped pipe 43*a*. The U-shaped pipe 43*a* is connected on the suction side of the compressor 31. The U-shaped pipe 43*a* has an oil-return hole 43*b*. Reference numeral 46 denotes an oil-return path. One end of the oil-return path 46 is connected to a lower part inside the oil separator 32, and the other end to a pipe on the suction side of the compressor 31. A capillary tube 47 is provided on oil-return path 46. Reference numeral 50 denotes a controller.

The outdoor unit 30 includes pressure sensors 46*a*, 47*b*, and 48*c*, which measure refrigerant pressure at positions where the pressure sensors 46*a*, 47*b*, and 48*c* are installed. The pressure sensor 46*a* is provided on the discharge side of the compressor 31. The pressure sensor 47*b* is provided on the suction side of the compressor 31. The pressure sensor 48*c* is provided between the outdoor flow control valve 36 and the flow control valve 4.

The outdoor unit 30 includes temperature sensors 49*a*, 49*b*, 49*c*, 49*d*, 49*e*, and 49*j*, which measure refrigerant temperature at positions where the temperature sensors 49*a*, 49*b*, 49*c*, 49*d*, 49*e*, and 49*j* are installed. The temperature sensor 49*a* is provided between the compressor 31 and the oil separator 32. The temperature sensor 49*b* is provided between the compressor 31 and the accumulator 43. The temperature sensor 49*c* is provided between the outdoor heat exchanger 34 and the four-way valve 33. The temperature sensor 49*d* is provided between the outdoor heat exchanger 34 and the subcooling heat exchanger 35. The temperature sensor 49*e* is provided among the subcooling heat exchanger 35, the outdoor flow control valve 36, and the subcooling regulating valve 21. The temperature sensor 49*j* is provided between the subcooling heat exchanger 35 and the accumulator 43, and between the subcooling heat exchanger 35 and the four-way valve 33. The outdoor unit 30 also includes a temperature sensor 49*k*, which measures the air temperature around the outdoor unit 30.

The indoor units 2 each include temperature sensors 49*f* and 49*h*, which measure refrigerant temperature at positions where the temperature sensors 49*f* and 49*h* are installed. The temperature sensor 49*f* is provided between the indoor heat exchanger 3 and the flow control valve 4. The temperature sensor 49*h* is provided between the indoor heat exchanger 3 and the main unit gas branch pipe 40.

The controller 50 includes, for example, a microcomputer. The controller 50 controls the operating frequency of the compressor 31, flow switching of the four-way valve 33, the rotation speed of the outdoor fan 60 for the outdoor heat exchanger 34, the opening degree of the outdoor flow control valve 36, the opening degree of the subcooling regulating valve 45, the opening degree of the flow control valves 4, the opening and closing state of the opening and closing valves 6, the rotation speed of the indoor fans 61 for the indoor heat exchangers 3, and the like, on the basis of measurement information by the pressure sensors 46*a*, 47*b*, ad 48*c* and the temperature sensors 49*a* to 49*k* and the operation details (load request) instructed from a user of an air-conditioning apparatus 1. Although the case where the controller 50 is provided in the outdoor unit 30 is illustrated in FIG. 1, the controller 50 is not necessarily provided in the outdoor unit 30. For example, a plurality of controllers 50 may be distributed to the outdoor unit 30 and the plurality of indoor units 2 so that communications including various data and the like can be transferred.

[Expansion Mechanism 10]

The configuration of the expansion mechanism 10 will now be explained.

Figure 2:
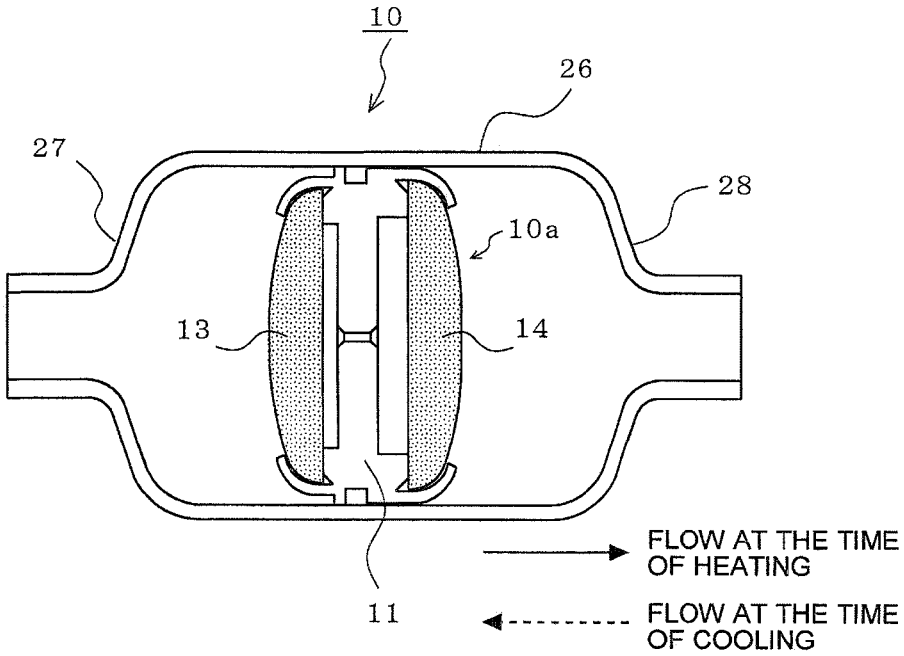
FIG. 2 is a configuration diagram of an expansion mechanism according to Embodiment 1.

FIG. 2 is a configuration diagram of an expansion mechanism according to Embodiment 1.

Figure 3:
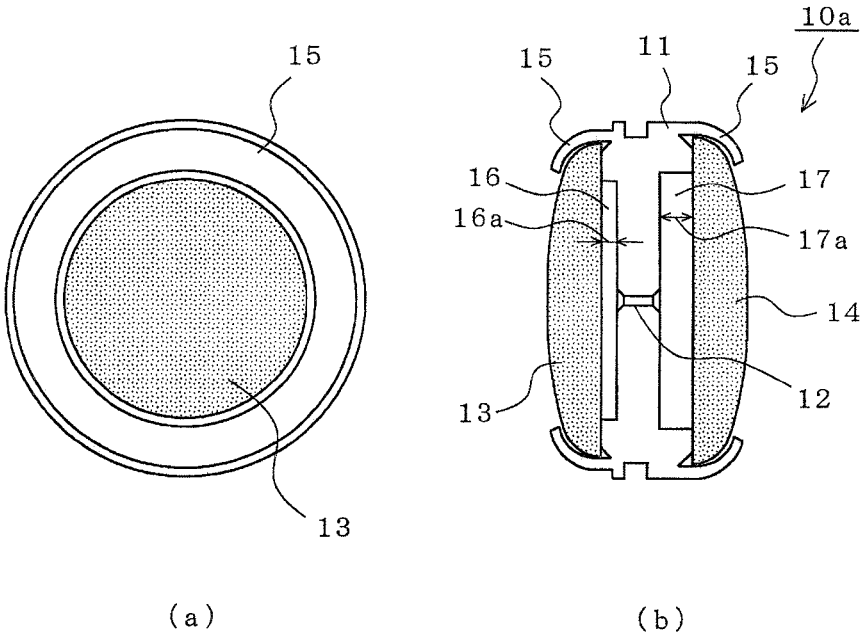
FIG. 3 includes configuration diagrams of an orifice structure inside the expansion mechanism according to Embodiment 1.

FIG. 3 includes configuration diagrams of an orifice structure inside the expansion mechanism according to Embodiment 1.

FIG. 3(*a*) is a front view of an orifice structure 10*a*. FIG. 3(*b*) is a left-side cross-sectional view of the orifice structure 10*a*.

Referring to FIGS. 2 and 3, the orifice structure 10*a* has a sandwich structure in which an orifice 12 is arranged at the center of an orifice carrier 11 and is sandwiched between an inlet-side porous body 13 and an outlet-side porous body 14 (hereinafter, may be collectively referred to as a porous body) on both sides of the orifice carrier 11, which has substantially a disc shape. With this sandwich structure, caulking is performed, with a caulking part 15 of the orifice carrier 11, on the orifice carrier 11 and a portion around the inlet-side porous body 13 and the outlet-side porous body 14, so that the orifice carrier 11, the inlet-side porous body 13, and the outlet-side porous body 14 are fixed.

As illustrated in FIG. 2, by press-fitting the orifice structure 10*a* into a copper pipe 26 from the inlet side of refrigerant flow (at the time of heating) in the copper pipe 26, the orifice structure 10*a* is fixed inside the copper pipe 26. Then, end portions 27 and 28 of the copper pipe 26 are narrowed down so that the orifice structure 10*a* is formed to have a shape with which a refrigerant pipe is connected. Accordingly, the expansion mechanism 10 is formed. The press-fit margin between the outer diameter of the orifice structure 10*a* to be press-fit into the expansion mechanism 10 and the inner diameter of the copper pipe 26 is about 25 μm. Press-fitting of the orifice structure 10*a* prevents the orifice structure 10*a* from moving even if the refrigerant pressure is applied. Furthermore, by forming the outer shell with the copper pipe 26, the outer shell of the expansion mechanism 10 can be configured at low cost.

Regarding the inlet side and the outlet side mentioned here, the refrigerant flow inlet and the refrigerant flow outlet in the direction of refrigerant flow at the time of heating operation are referred to as the inlet side and the outlet side, respectively. At the time of cooling operation, the refrigerant flows from the outlet-side porous body 14 toward the inlet-side porous body 13. The flow of refrigerant will be explained later.

At the time of heating operation, slugs (bubbles) in the refrigerant flowing into the expansion mechanism 10 formed as described above pass through innumerable minute air holes of the inlet-side porous body 13 and turn into small bubbles, accordingly, a vapor refrigerant and a liquid refrigerant pass through the orifice 12 at the same time. Since the flow velocity of refrigerant inside the outlet-side porous body 14 is sufficiently decreased and uniform velocity distribution is obtained by the outlet-side porous body 14, no large eddies occur in jets downstream the orifice 12, thus the jet flow noise (refrigerant flow noise) is decreased.

Furthermore, slugs (bubbles) in the refrigerant flowing into the expansion mechanism 10 at the time of cooling operation pass through the innumerable minute air holes of the outlet-side porous body 14 and turn into small bubbles, accordingly, the vapor refrigerant and the liquid refrigerant pass through the orifice 12 at the same time. Since the flow velocity of refrigerant inside the inlet-side porous body 13 is sufficiently decreased and uniform velocity distribution is obtained by the inlet-side porous body 13, no large eddies occur in jets downstream the orifice 12, thus the jet flow noise (refrigerant flow noise) is decreased.

[Detailed Configuration of Orifice Structure 10*a*]

Here, the detailed configuration of the orifice structure 10*a* will be explained.

The whole inlet-side porous body 13 and outlet-side porous body 14 are formed of porous transmitting materials. The average diameter of air holes, that is, air holes through which fluid can transmit and which are arranged on surfaces and inside a porous body, is about 500 μm, and the porosity is 92±6%. The porous body is obtained by applying metal powder on urethane foam, performing heat treatment so that the urethane foam is burned off, and forming metal to have a three-dimensional grid pattern. The porous body is made from Ni (nickel). In order to increase the strength of the porous body, plating or permeation processing may be performed on Cr (chromium).

Spaces 16 and 17 are arranged between the inlet-side porous body 13 and the orifice 12 and between the outlet-side porous body 14 and the orifice 12, respectively. By providing the spaces 16 and 17, wide passages can be obtained between the inlet-side porous body 13 and the orifice 12 and between the outlet-side porous body 14 and the orifice 12. Therefore, even if foreign substances are deposited in parts of meshes of the inlet-side porous body 13 and the outlet-side porous body 14, since a plurality of passages exist in another porous body portion, the risk of clogging can be avoided. Furthermore, by connecting the opening and closing valve 6 in series with the expansion mechanism 10 and closing the opening and closing valve 6 at the rated load or the peak load, the amount of refrigerant flow passing through the expansion mechanism 10 is set to zero, thus further avoiding a reliability problem regarding clogging with foreign substances.

In addition, setting a length 16*a* of the space 16 between the inlet-side porous body 13 and the orifice 12 to 1 mm, which is equal to the diameter of the orifice 12, prevents bubbles micronized by the inlet-side porous body 13 from gathering again and becoming larger than the diameter ϕ of the orifice 12, which is 1 mm. This suppresses variations in pressure while avoiding the risk of clogging.

Although the length 16*a* is set to be equal to the diameter of the orifice 12 in the aforementioned explanation, the present invention is not limited to this. The length 16*a* of the space 16 only needs to be smaller than or equal to the diameter of the orifice 12.

Furthermore, the refrigerant passing through the orifice 12 is spread conically. Thus, by setting a length 17*a* of the space 17 between the outlet-side porous body 14 and the orifice 12 to 2 mm, which is greater than the diameter of the orifice 12, which is 1 mm, the flow velocity of refrigerant decreases at the time when the refrigerant that has passed through the orifice 12 reaches the outlet-side porous body 14. The decrease in the flow velocity suppresses sand erosion of the mesh of a porous body, which occurs when the refrigerant contains fine powder of metal or the like.

Although the length 17*a* is set to 2 mm in the aforementioned explanation, the present invention is not limited to this. The length 17*a* of the space 17 only needs to be equal to or greater than the diameter of the orifice 12.

Here, in the case where the length 16*a* and the length 17*a* with respect to the orifice 12 differ from each other, the orifice structure 10*a* needs to be mounted in the refrigerant circuit in a correct direction. Thus, as illustrated in FIG. 3, by making the diameter of the inlet-side porous body 13 to be different from the diameter of the outlet-side porous body 14, the inlet or outlet direction can be identified. More specifically, by setting the diameter of the inlet-side porous body 13 to 20 mm and the diameter of the outlet-side porous body 14 to 21 mm, an operator is able to easily identify a porous body to be mounted is the inlet-side porous body 13 or the outlet-side porous body 14. Furthermore, by making the diameter of the inlet-side porous body 13 to be different from the diameter of the outlet-side porous body 14, misuse of a porous body to be mounted can be prevented in the case where different materials are used for the inlet-side porous body 13 and the outlet-side porous body 14.

[Operation]

The operation of the air-conditioning apparatus 1 will now be explained.

First, the case where a certain amount of refrigerant flows to each of the indoor units 2, such as at the rated load or peak load, will be explained. At this time, due to closure of the opening and closing valve 6 or the difference in flow resistance between the flow control valve 4 and the expansion mechanism 10, almost all refrigerants are regarded as passing through the flow control valve 4. Furthermore, since the indoor fans 61 run at high rotation speed, wind noise or motor noise caused by the fan is increased. Therefore, in this case, refrigerant operation noise is not a noise source.

[Cooling Operation]

First, operation at the time of cooling operation will be explained.

The four-way valve 33 is connected in the broken-line direction in FIG. 1. The outdoor flow control valve 36 is set to be in a fully-opened or nearly fully-opened state, and each of the subcooling regulating valve 45 and the flow control valve 4 is set to have an appropriate opening degree. In this case, the refrigerant flows as described below.

When passing through the oil separator 32, refrigerating machine oil mixed in high-pressure high-temperature refrigerant gas discharged from the compressor 31 is mostly separated and accumulated at the inner bottom of the oil separator 32, and the refrigerant passes through the oil-return path 46, is subjected to adjustment of the amount of oil return while being reduced in pressure by the capillary tube 47, and reaches the suction side of the compressor 31. Accordingly, the refrigerating machine oil existing in a portion from the oil separator 32 to the accumulator 43 can be reduced, thus achieving an effect of improving the reliability of the compressor.

Meanwhile, the high-pressure high-temperature refrigerant whose percentage of refrigerating machine oil has been reduced passes through the four-way valve 33, is condensed by the outdoor heat exchanger 34 to be turned into the high-pressure low-temperature refrigerant, and enters the subcooling heat exchanger 35. One of the branched flows from the subcooling heat exchanger 35 is subjected to appropriate flow control by the subcooling regulating valve 45 to be turned into the low-pressure refrigerant, and exchanges heat with the refrigerant from the outdoor heat exchanger 34 in the subcooling heat exchanger 35. The refrigerant from the outdoor heat exchanger 34 passes through the subcooling heat exchanger 35 and turns into the high-pressure and lower-temperature refrigerant. The other low-pressure refrigerant from the subcooling heat exchanger 35 reaches a pipe which connects the accumulator 43 and the four-way valve 33 together.

Accordingly, in the case of the same capacity, an increase in the enthalpy difference reduces the required refrigerant flow, thus achieving an effect of improving the performance by reducing pressure loss. Furthermore, refrigerating machine oil in a path from the outdoor unit 30 via the indoor unit 2 to the outdoor unit 30 again can be reduced, thus achieving an effect of improving the reliability of the compressor.

The terms "high pressure" and "low pressure" mentioned here represent the relative relationship of pressure inside the refrigerant circuit (the same applies to temperature).

Meanwhile, the high-pressure refrigerant from the subcooling heat exchanger 35 passes through the outdoor flow control valve 36 and is supplied to the liquid main pipe 37 as the high-pressure low-temperature refrigerant whose pressure has not been very reduced because the outdoor flow control valve 36 is fully opened. Then, the refrigerant is branched at the connection point 38 of the liquid main pipe, passes through the liquid branch pipe 39, and enters the indoor unit 2. Then, the pressure of the refrigerant is reduced by the flow control valve 4, and turns into the two-phase gas-liquid refrigerant at low pressure and low quality. Then, the refrigerant is evaporated and gasified by the indoor heat exchanger 3, passes through the gas branch pipe 40, the connection point 41 of the gas main pipe, the gas main pipe 42, the four-way valve 33, and the accumulator 43, and is sucked into the compressor 31.

When the two-phase gas-liquid refrigerant flows into the accumulator 43, the liquid refrigerant is accumulated at the bottom of the container, and the gas-rich refrigerant flowing from an upper opening of the U-shaped pipe is sucked into the compressor 31. Liquid return to the compressor 31 can be temporarily prevented until transient liquid and the two-phase gas-liquid refrigerant accumulated in the accumulator 43 overflow, thus achieving an effect of improving the reliability of the compressor.

Furthermore, refrigerating machine oil not separated by the oil separator 32 circulates in the refrigerant circuit for a long time and is eventually accumulated in the accumulator 43.

The refrigerating machine oil in the accumulator 43 returns to the compressor 31 through the oil-return hole 43*b*, which is located at the lowest position relative to the upper opening of the U-shaped pipe 43*a*, in the form of oil when the liquid refrigerant does not exist inside the refrigerating machine oil, or in the state in which the liquid refrigerant and refrigerating machine oil are dissolved when liquid refrigerant exists inside the refrigerating machine oil.

[Control Operation at the Time of Cooling Operation]

A control operation performed by the controller 50 of the air-conditioning apparatus 1 will now be explained.

Figure 4:
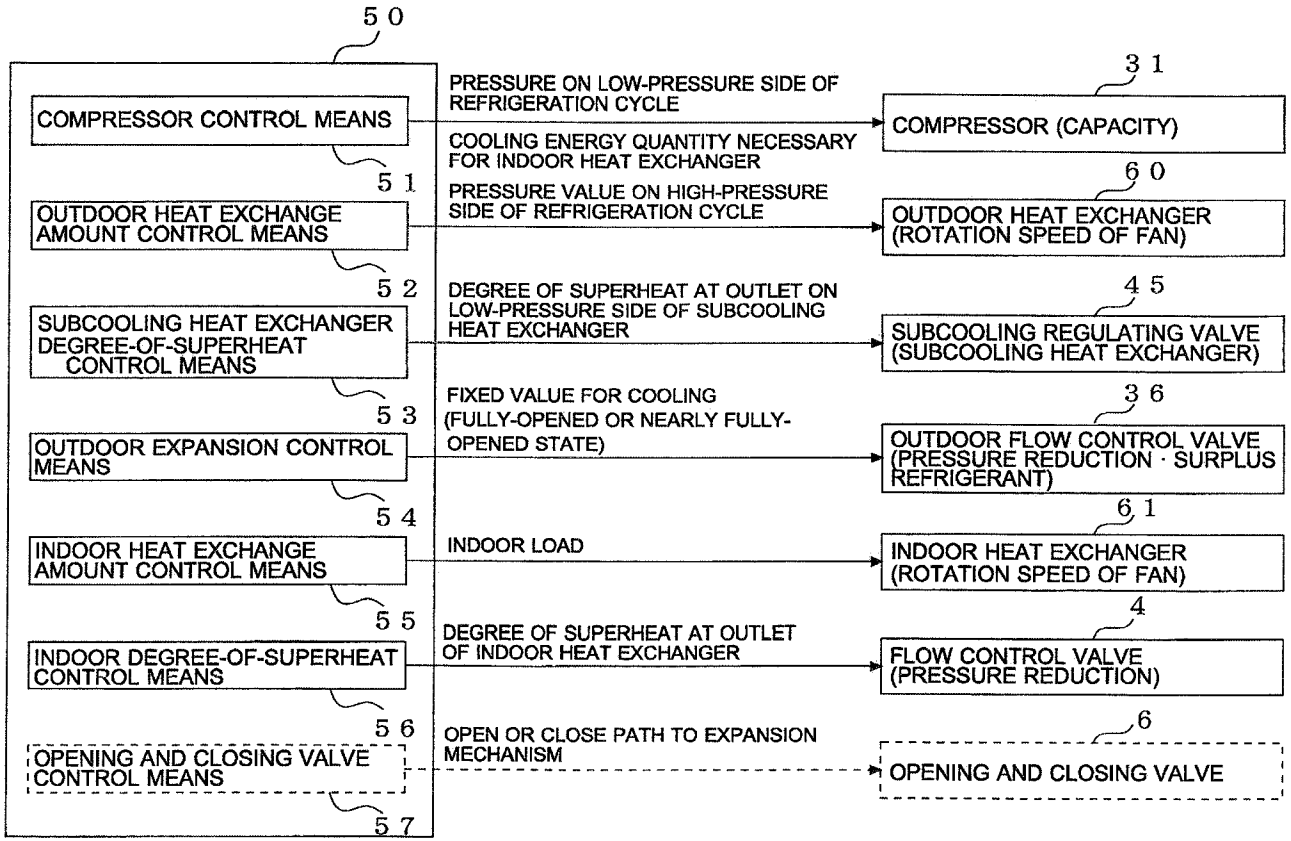
FIG. 4 illustrates the configuration of a controller and a control operation at the time of cooling operation according to Embodiment 1.

FIG. 4 illustrates the configuration of a controller and a control operation at the time of cooling operation according to Embodiment 1.

Referring to FIG. 4, the controller 50 includes compressor control means 51, outdoor heat exchange amount control means 52, subcooling heat exchanger degree-of-superheat control means 53, outdoor expansion control means 54, indoor heat exchange amount control means 55, indoor degree-of-superheat control means 56, and opening and closing valve control means 57.

During the cooling operation, since the indoor heat exchanger 3 serves as an evaporator, evaporating temperature (two-phase refrigerant temperature of the evaporator) is set so that a specific heat exchange capacity is exhibited and a low pressure value realizing the set evaporating temperature is set as a low-pressure target value. Then, the compressor control means 51 performs rotation speed control using an inverter.

The compressor control means 51 controls the operation capacity of the compressor 31 in such a manner that the pressure value on the low-pressure side measured by the pressure sensor 47*b* is equal to the set target value, for example, a pressure corresponding to a saturation temperature of 10 degrees C. At the same time, condensing temperature (two-phase refrigerant temperature in the condenser) is also changed by the rotation speed control. In order to ensure the performance and reliability, a certain range of temperature is set as condensing temperature, and the value of pressure realizing the condensing temperature is set as a high-pressure target value. The compressor control means 51 and the outdoor heat exchange amount control means 52 control the rotation speed of the outdoor fan 60 that carries air, which is a heat-transmission medium, in such a manner that pressures measured by the pressure sensors 46*a* and 47*b* are within the target range, on the basis of a state that is defined in advance from the heat exchange amount of the outdoor heat exchanger 34 and the heat exchange amount of the indoor heat exchanger 3.

The indoor degree-of-superheat control means 56 controls the opening degree of the flow control valve 4 in such a manner that the degree of superheat at the outlet of the indoor heat exchanger 3 calculated by subtracting (the temperature of the temperature sensor 49*f*) from (the temperature of the temperature sensor 49*h*) is set to a target value (temperature). A predetermined target value, for example, 2 degrees C., is set as the target value. By controlling the opening degree of the flow control valve 4 in order for the outlet superheat degree of the indoor heat exchanger 3 to become the target value, the proportion of two-phase refrigerant in the evaporator can be maintained in a desired condition. Furthermore, in order to stop the operation of the indoor unit 2, the controller 50 causes the indoor degree-of-superheat control means 56 to fully close the flow control valve 4.

The opening and closing valve control means 57 operates together with the indoor degree-of-superheat control means 56. When the opening degree of the flow control valve 4 is small (for example, smaller than a specific opening degree), the opening and closing valve control means 57 opens the opening and closing valve 6. When the opening degree of the flow control valve 4 is large (for example, equal to or greater than the specific opening degree), the opening and closing valve control means 57 closes the opening and closing valve 6. In the case where the operation of the indoor unit 2 is stopped and the flow control valve 4 is fully closed, the opening and closing valve 6 is closed. An opening degree at which the flow resistance of the flow control valve 4 is equal to the flow resistance in the expansion mechanism 10 is set as the specific opening degree. The specific opening degree is not necessarily limited to the aforementioned opening degree. Any opening degree may be set as the specific opening degree. For example, an opening degree at which the refrigerant flow noise occurring in the flow control valve 4 is larger than the driving noise of the indoor fan 61 may be set as the specific opening degree. Furthermore, the aforementioned opening degree may be changed between the cooling operation and heating operation (described later).

Here, in the case where indoor load, such as the rated load or peak load, is large, the refrigerant flow amount needs to be increased in order to achieve a desired outlet heat degree, thus the opening degree of the flow control valve 4 is set to be large. At this time, the opening and closing valve 6 is closed, and no refrigerant circulates in the expansion mechanism 10 having porous bodies. Therefore, in the case where indoor load, such as the rated load or peak load, is large, and the refrigerant flow amount is large, chances of a porous body of the expansion mechanism 10 capturing foreign substances can be decreased. Furthermore, in the case where the refrigerant flow amount is large, since no refrigerant circulates in the expansion mechanism 10, there is no need to take measures to decrease the flow resistance in the expansion mechanism 10.

Furthermore, as described later, in the case where indoor load, such as the rated load or peak load, is large, a larger amount of cold air needs to be supplied into the room, thus the rotation speed of the indoor fan 61 is increased. Therefore, the refrigerant flow noise of the flow control valve 4 is relatively small compared to noise caused by driving of the indoor fan 61, and hence the refrigerant flow noise is not the main factor of the noise of the indoor unit.

The indoor heat exchange amount control means 55 controls the rotation speed of the indoor fan 61. The rotation speed of the indoor fan 61 is controlled such that the suction air temperature of the indoor unit 2 is equal to a set temperature defined by the user. Alternatively, the rotation speed is controlled in accordance with the air flow rate specified by a user operation. The rotation speed control for the indoor fan 61 by the indoor heat exchange amount control means 55 is performed prior to the above-described opening degree control for the flow control valve 4 by the indoor degree-of-superheat control means 56 and opening and closing control for the opening and closing valve 6 by the opening and closing valve control means 57. The rotation speed control for the indoor fan 61 includes a start and stop of operation.

In order to stop an indoor unit 2 in operation, the controller 50 causes the indoor unit 2 to stop by causing the indoor heat exchange amount control means 55 to set the rotation speed of the indoor fan 61 to zero. Then, the controller 50 causes the indoor degree-of-superheat control means 56 to control the opening degree of the flow control valve 4 and causes the opening and closing valve control means 57 to control opening and closing of the opening and closing valve 6. Accordingly, in the case where the indoor unit 2 is stopped due to a decrease in indoor load or in the case where a stop operation is performed since the user determines that it is too cold, cold air is not supplied into the room, thus the comfortability is maintained. Furthermore, in order to stop the indoor unit 2, the opening degree of the flow control valve 4 is narrowed by the indoor degree-of-superheat control means 56 and the flow control valve 4 eventually becomes fully closed. In this transition time, when the opening degree of the flow control valve 4 becomes smaller, the opening and closing valve 6 is opened, thus the refrigerant circulates in the expansion mechanism 10 having porous bodies. Therefore, refrigerant flow noise can be suppressed.

In order to activate a stopped indoor unit 2, the controller 50 causes the indoor degree-of-superheat control means 56 to control the opening degree of the flow control valve 4 and causes the opening and closing valve control means 57 to control opening and closing of the opening and closing valve 6, and then causes the indoor heat exchange amount control means 55 to start the rotating operation of the indoor fan 61. Accordingly, cold air can be blown from the indoor unit 2 in the state in which the temperature of refrigerant flowing in the indoor heat exchanger 3 is sufficiently low.

The outdoor expansion control means 54 controls the opening degree of the outdoor flow control valve 36 to an initial opening degree set in advance, for example, a fully-opened state or nearly fully-opened state. Furthermore, the subcooling heat exchanger degree-of-superheat control means 53 controls the opening degree of the subcooling regulating valve 45 in such a manner that the degree of superheat at the outlet on the low-pressure side of the subcooling heat exchanger 35, which is calculated by subtracting (the saturation temperature converted from the pressure measured by the pressure sensor 48*c*) from (the temperature of the temperature sensor 49*j*), is equal to a target value. For example, 2 degrees C. is set as the target value, and heat exchange suitable for the specifications of the subcooling heat exchanger 35 can be realized.

[Heating Operation]

A heating operation will now be explained.

The four-way valve 33 is connected in the solid line direction in FIG. 1. The opening degree of the outdoor flow control valve 36 is set in advance so that an appropriate pressure difference occurs between upstream and downstream of the outdoor flow control valve 36. The subcooling regulating valve 45 is set to be fully closed, and the flow control valve 4 is set to have an appropriate opening degree. In this case, the refrigerant flows as described below.

High-pressure high-temperature refrigerant gas discharged from the compressor 31 passes through the oil separator 32 and the four-way valve 33 and then flows into the gas main pipe 42. The oil separator 32 operates in the same manner as described for cooling operation. The refrigerant passing through the gas main pipe 42 and supplied to the indoor unit 2 is condensed by the indoor heat exchanger 3 inside the indoor unit 2 and turns into the high-pressure low-temperature refrigerant. The pressure of the high-pressure low-temperature refrigerant is reduced by the flow control valve 4, and the refrigerant turns into the medium-pressure liquid-phase or two-phase gas-liquid refrigerant close to saturated liquid. The medium-pressure refrigerant passes through the liquid main pipe 37, and flows into the outdoor unit 30. Then, the refrigerant passes through the outdoor flow control valve 36 and turns into a low-pressure two-phase state. The refrigerant in the low-pressure two-phase state passes through the subcooling heat exchanger 35, evaporates at the outdoor heat exchanger 34 to be turned into the low-pressure low-temperature refrigerant. The low-pressure low-temperature refrigerant passes through the accumulator 43 and is sucked into the compressor 31. The accumulator 43 operates in the same manner as described for the cooling operation. The subcooling regulating valve 45 is fully closed and hence no flow occurs in the subcooling regulating valve 45. No heat exchange is performed in the subcooling heat exchanger 35. Flowing in the subcooling regulating valve 45 decreases the performance as heat exchange is performed, which is not desirable.

[Control Operation at the Time of Heating Operation]

A control operation performed by the controller 50 of the air-conditioning apparatus 1 will now be explained.

Figure 5:
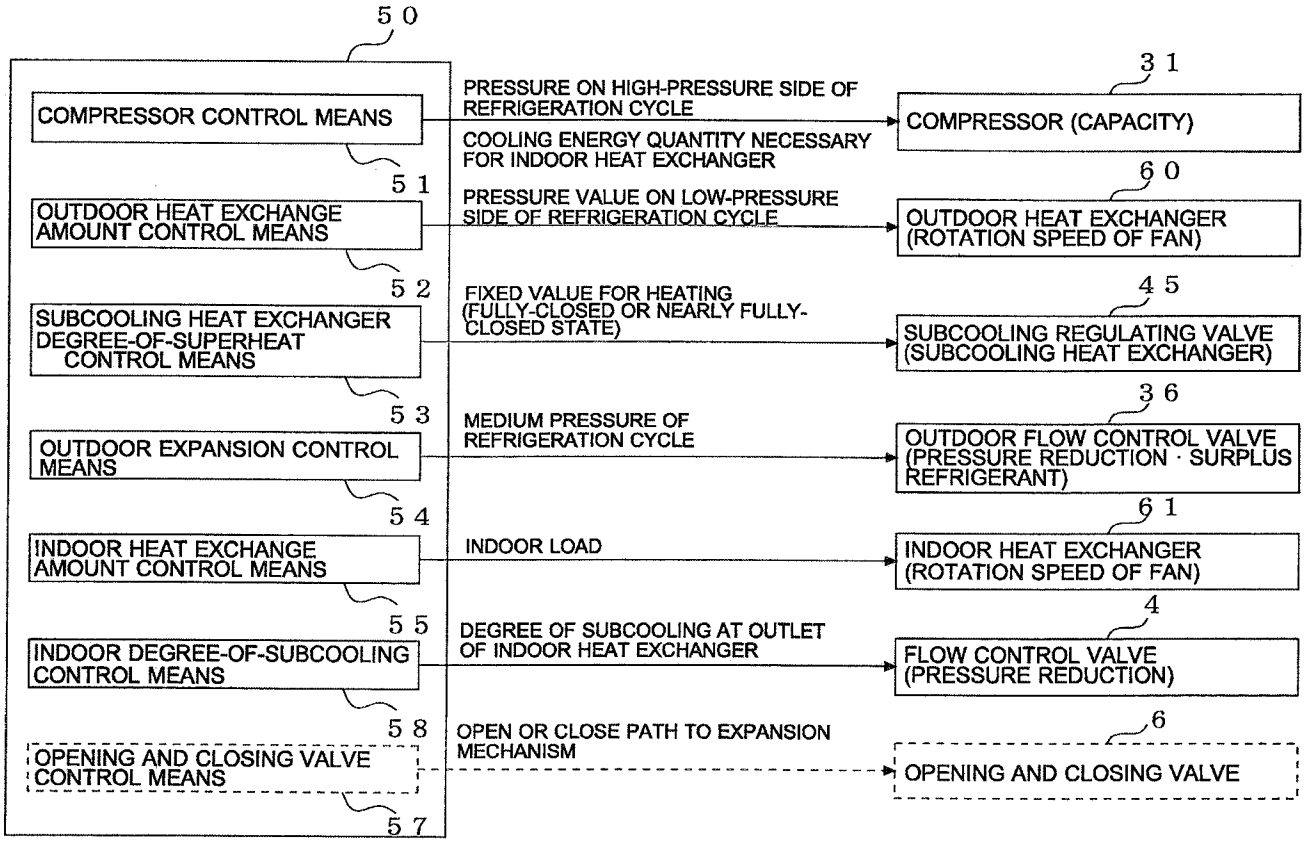
FIG. 5 illustrates the configuration of the controller and a control operation at the time of heating operation according to Embodiment 1.

FIG. 5 illustrates the configuration of the controller and a control operation at the time of heating operation according to Embodiment 1.

Referring to FIG. 5, the controller 50 includes the compressor control means 51, the outdoor heat exchange amount control means 52, the subcooling heat exchanger degree-of-superheat control means 53, the outdoor expansion control means 54, the indoor heat exchange amount control means 55, an indoor degree-of-subcooling control means 58, and the opening and closing valve control means 57.

During the heating operation, since the indoor heat exchanger 3 serves as a condenser, condensing temperature is set so that a specific heat exchange amount is exhibited and a high pressure value realizing the set condensing temperature is set as a high-pressure target value. Then, the compressor control means 51 performs rotation speed control using an inverter.

The compressor control means 51 controls the operation capacity of the compressor 31 in such a manner that the pressure value on the high-pressure side measured by the pressure sensor 46*a* is equal to the set target value, for example, a pressure corresponding to a saturation temperature of 50 degrees C. At the same time, the evaporating temperature of the outdoor heat exchanger 34 is changed by the rotation speed control. A certain range of temperature is set as evaporating temperature in order to ensure the performance and reliability. The value of pressure realizing the evaporating temperature is set as a low-pressure target value. The compressor control means 51 and the outdoor heat exchange amount control means 52 control the rotation speed of the outdoor fan 60 that carries air, which is a heat-transmission medium, in such a manner that a low pressure value measured by the pressure sensor 47*a* is within the target range, on the basis of a state that is defined in advance from the heat exchange amount of the outdoor heat exchanger 34 and the heat exchange amount of the indoor heat exchanger 3.

The indoor degree-of-subcooling control means 58 controls the opening degree of the flow control valve 4 in such a manner that the degree of subcooling at the outlet of the indoor heat exchanger 3, which is calculated by subtracting (the temperature of the temperature sensor 490 from (the saturation temperature converted from pressure measured by the pressure sensor 46*a*), is set to a target value (temperature). A predetermined target value, for example, 10 degrees C., is set as the target value.

The opening and closing valve control means 57 operates together with the indoor degree-of-subcooling control means 58. When the opening degree of the flow control valve 4 is small (for example, smaller than a specific opening degree), the opening and closing valve control means 57 opens the opening and closing valve 6. When the opening degree of the flow control valve 4 is large (for example, equal to or greater than the specific opening degree), the opening and closing valve control means 57 closes the opening and closing valve 6. When the operation of the indoor unit 2 is stopped and the flow control valve 4 is fully closed, the opening and closing valve 6 is closed. An opening degree at which the flow resistance of the flow control valve 4 is equal to the flow resistance in the expansion mechanism 10 is set as the specific opening degree. The specific opening degree is not necessarily limited to the aforementioned opening degree. Any opening degree may be set as the specific opening degree. For example, an opening degree at which the refrigerant flow noise occurring in the flow control valve 4 is larger than the driving noise of the indoor fan 61 may be set as the specific opening degree. Furthermore, the aforementioned opening degree may be changed between the cooling operation described above and heating operation.

Here, in the case where indoor load, such as the rated load or peak load, is large, the refrigerant flow amount needs to be increased in order to achieve a desired outlet subcooling degree, thus the opening degree of the flow control valve 4 is set to be large. At this time, the opening and closing valve 6 is closed, and no refrigerant circulates in the expansion mechanism 10 having porous bodies. Therefore, in the case where indoor load, such as the rated load or peak load, is large, and the refrigerant flow amount is large, chances of a porous body of the expansion mechanism 10 capturing foreign substances can be decreased. Furthermore, in the case where the refrigerant flow amount is large, since no refrigerant circulates in the expansion mechanism 10, there is no need to take measures to decrease the flow resistance in the expansion mechanism 10.

Furthermore, as described later, in the case where indoor load, such as the rated load or peak load, is large, a larger amount of warm air needs to be supplied into the room, thus the rotation speed of the indoor fan 61 is increased. Therefore, the refrigerant flow noise of the flow control valve 4 is relatively small compared to noise caused by driving of the indoor fan 61, and hence the refrigerant flow noise is not the main factor of the noise of the indoor unit.

The indoor heat exchange amount control means 55 controls the rotation speed of the indoor fan 61. The rotation speed of the indoor fan 61 is controlled such that the suction air temperature of the indoor unit 2 is equal to a set temperature defined by the user. Alternatively, the rotation speed is controlled in accordance with the air flow rate specified by a user operation. The rotation speed control for the indoor fan 61 by the indoor heat exchange amount control means 55 is performed prior to the above-described opening degree control for the flow control valve 4 by the indoor degree-of-subcooling control means 58 and opening and closing control for the opening and closing valve 6 by the opening and closing valve control means 57. The rotation speed control for the indoor fan 61 includes a start and stop of operation.

In order to stop an indoor unit 2 in operation, the controller 50 causes the indoor unit 2 to stop by causing the indoor heat exchange amount control means 55 to set the rotation speed of the indoor fan 61 to zero, and then causes the indoor degree-of-subcooling control means 58 to control the opening degree of the flow control valve 4 and causes the opening and closing valve control means 57 to control opening and closing of the opening and closing valve 6. Accordingly, in the case where indoor load decreases and the indoor unit 2 is stopped or in the case where the user determines that it is too hot and a stop operation is performed, warm air is not supplied into the room, thus the comfortability is maintained. Furthermore, in order to stop the indoor unit 2, the opening degree of the flow control valve 4 is narrowed by the indoor degree-of-subcooling control means 58 and the flow control valve 4 eventually becomes fully closed. In this transition time, when the opening degree of the flow control valve 4 becomes smaller, the opening and closing valve 6 is opened, thus the refrigerant circulates in the expansion mechanism 10 having porous bodies. Therefore, refrigerant flow noise can be suppressed.

In order to activate a stopped indoor unit 2, the controller 50 causes the indoor degree-of-subcooling control means 58 to control the opening degree of the flow control valve 4 and causes the opening and closing valve control means 57 to control opening and closing of the opening and closing valve 6, and then causes the indoor heat exchange amount control means 55 to start the rotating operation of the indoor fan 61. Accordingly, warm air can be blown from the indoor unit 2 in the state in which the temperature of refrigerant flowing in the indoor heat exchanger 3 is sufficiently high.

The subcooling heat exchanger degree-of-superheat control means 53 controls the subcooling regulating valve 45 to be fixed at an initial opening degree set in advance, for example, to an opening degree of a fully-closed or nearly fully-closed state.

The outdoor expansion control means 54 controls the opening degree of the outdoor flow control valve 36 in such a manner that the saturation temperature converted from pressure measured by the pressure sensor 48*c* is equal to a value obtained by subtracting (the target value of outlet subcooling degree) from (the saturation temperature determined from a high-pressure target value).

Here, differences between the heating operation and cooling operation will be considered. The high-pressure liquid refrigerant exists in the liquid main pipe 37 and the liquid branch pipe 39 during the cooling operation, whereas the medium-pressure liquid-phase or two-phase gas-liquid refrigerant close to saturated liquid exists in the liquid main pipe 37 and the liquid branch pipe 39 during the heating operation. Thus, compared to cooling operation, the refrigerant cannot be sufficiently accumulated in the liquid main pipe 37 and the liquid branch pipe 39 and hence an excess refrigerant exists in heating operation. The excess refrigerant exists as a liquid refrigerant in the accumulator 43. Since an air-conditioning apparatus having a large capacity includes a liquid main pipe 37 and liquid branch pipe 39 of large pipe diameter and length, the amount of excess refrigerant further increases.

However, if the outdoor flow control valve 36 were not provided, the refrigerant existing in the liquid main pipe 37 and the liquid branch pipe 39 is in a low-pressure two-phase state, and thus the amount of excess refrigerant increases. By adjusting the opening degree of the outdoor flow control valve 36, high density in the liquid main pipe 37 and the liquid branch pipe 39 suppresses the amount of excess refrigerant. Furthermore, since appropriately adjusting the opening degree of the outdoor flow control valve 36 during the cooling operation reduces the amount of liquid refrigerant in the liquid main pipe 37 and the liquid branch pipe 39 during the cooling operation, the excess refrigerant during the heating operation can be suppressed.

In general, the capacity of the outdoor heat exchanger 34 is greater than the capacity of the indoor heat exchanger 3, and a difference in capacity when using the indoor heat exchanger 3 and the outdoor heat exchanger 34 as condensers is an excess refrigerant at the time of heating. A value obtained by multiplying the sum of excess refrigerant inside the heat exchangers and the excess refrigerant in the liquid main pipe 37 and the liquid branch pipe 39 by a safety factor serves as the capacity of the accumulator 43. A large total capacity of the accumulator 43 of the air-conditioning apparatus 1 affects the cost and compactness.

Furthermore, the subcooling heat exchanger 35 is used for cooling but not for heating in order to reduce pressure loss in a circuit on the low-pressure side during cooling.

The explanations for the cooling operation and the heating operation provided above represent the case where indoor load is equal to the rated load, which is equivalent to the rated capacity of the air-conditioning apparatus 1.

The case where indoor load is partial load, which is smaller than the rated capacity of an air-conditioning apparatus, will be described next.

[Partial Load at the Time of Cooling Operation]

First, partial load at the time of cooling operation will be explained.

The number of indoor units 2 in operation and the amount of refrigerant flowing in each of the indoor units 2 decrease as indoor load decreases, thereby decreasing the total refrigerant flow amount. The amount of heat exchange in the subcooling heat exchanger 35 decreases. A tolerance generated in the subcooling heat exchanger 35 causes subcooling to occur in the refrigerant flowing to the indoor unit 2, and refrigerant flow noise is unlikely to occur in the flow control valve 4.

In contrast, in the case where indoor load is extremely small, there is a possibility that high pressure and low pressure cannot be controlled to attain a target value, thus reducing a difference between high pressure and low pressure. In this case, a temperature difference cannot be ensured in the subcooling heat exchanger 35, and the two-phase gas-liquid refrigerant may flow into the indoor unit 2. The two-phase gas-liquid refrigerant flowing into the flow control valve 4 may cause refrigerant flow noise to occur.

In the case where indoor load is extremely small, the indoor degree-of-superheat control means 56 sets the opening degree of the flow control valve 4 to be small. In this embodiment, since the opening and closing valve 6 is opened when the opening degree of the flow control valve 4 is small (for example, smaller than a specific opening degree), a larger amount of refrigerant flows toward the expansion mechanism 10, which has a small flow resistance.

In the case where the two-phase gas-liquid refrigerant passes through a flow control device of a normal orifice type, large refrigerant flow noise occurs around upstream and downstream of an expansion unit. In particular, large refrigerant flow noise occurs upstream of the expansion unit in the case where the flow regime of the two-phase gas-liquid refrigerant is a slug flow pattern.

This is because in the case where the flow regime of the two-phase gas-liquid refrigerant is a slug flow pattern, a vapor refrigerant intermittently flows in the flow direction, thus collapse of a large vapor slug or vapor bubble upstream of the expansion unit passage when the vapor slug or vapor bubble passes through the expansion unit passage causes the refrigerant to oscillate. Furthermore, since the vapor refrigerant and liquid refrigerant pass reciprocally, the refrigerant flows quickly when the vapor refrigerant passes but the refrigerant flows slowly when the liquid refrigerant passes. In accordance with this, the pressure upstream the expansion unit also fluctuates. Furthermore, since existing flow control devices include a plurality of outlet passages, the refrigerant flowing at high velocity turns into a high-speed two-phase gas-liquid flow in the outlet portion. The refrigerant collides against a wall surface, and hence the expansion unit main body and the outlet passages always oscillate, which generates noise. Furthermore, due to disturbance by high-speed two-phase gas-liquid jet streams or occurrence of eddies at the outlet portion, jet flow noise (refrigerant flow noise) also increases.

In contrast, at the time of cooling operation according to this embodiment, the two-phase gas-liquid refrigerant flows into the expansion mechanism 10 and passes through innumerable minute air holes of the outlet-side porous body 14, which is the side into which the refrigerant flows at the time of cooling operation, thus vapor slugs (large bubbles) turn into small bubbles. Therefore, the refrigerant enters a homogeneous two-phase gas-liquid flow state (state in which a vapor refrigerant and liquid refrigerant are mixed sufficiently). Consequently, the vapor refrigerant and the liquid refrigerant pass through the orifice 12 at the same time, and no change occurs in refrigerant velocity or pressure.

Furthermore, in the case of a porous transmitting material such as the outlet-side porous body 14, the inner passage is configured in a complicated manner, in which pressure fluctuations occur repeatedly, and has an effect of causing pressure fluctuation to remain constant while performing partial conversion into thermal energy. Thus, an effect of absorbing a pressure fluctuation occurring in the orifice 12 is achieved, thereby transmitting less influence on an upstream portion.

Furthermore, the flow velocity of refrigerant of high-speed two-phase gas-liquid jet flow at downstream of the orifice 12, which is on the refrigerant outflow side at the time of cooling operation, is sufficiently reduced by the inlet-side porous body 13, thereby uniformizing the velocity distribution. Thus, the high-speed two-phase gas-liquid jet flow does not collide against the wall surface or no large eddies occur in the flow, resulting in a decrease in jet flow noise (refrigerant flow noise).

As described above, even in the case where the two-phase gas-liquid refrigerant is supplied to the indoor units 2, refrigerant flow noise can be suppressed.

Furthermore, in the case where indoor load is small at the time of cooling operation or in accordance with a user operation, the controller 50 causes the operation of one or more of the plurality of indoor units 2 to stop and causes the other indoor unit(s) 2 to operate. In order to stop an indoor unit 2 that is performing the cooling operation, the controller 50 causes the indoor degree-of-superheat control means 56 to fully close the flow control valve 4 and causes the opening and closing valve control means 57 to close the opening and closing valve 6.

Furthermore, in order to stop an indoor unit 2 in operation, the controller 50 causes the indoor unit 2 to stop by causing the indoor heat exchange amount control means 55 to set the rotation speed of the indoor fan 61 to zero. Then, the controller 50 causes the indoor degree-of-superheat control means 56 to control the opening degree of the flow control valve 4 and causes the opening and closing valve control means 57 to control opening and closing of the opening and closing valve 6. Thus, in the case where the indoor unit 2 is stopped due to a decrease in indoor load or in the case where a stop operation is performed since a user determines that it is too cold, cold air is not supplied into the room and the comfortability is thus maintained. Furthermore, in order to stop the indoor unit 2, the opening degree of the flow control valve 4 is narrowed by the indoor degree-of-superheat control means 56 and the flow control valve 4 is eventually fully closed. In this transition time, when the opening degree of the flow control valve 4 decreases, the opening and closing valve 6 is opened, thus circulating the refrigerant in the expansion mechanism 10 having porous bodies. Therefore, refrigerant flow noise can be suppressed.

In the case where indoor load increases or in the case where a stopped indoor unit 2 is activated in accordance with a user operation, the controller 50 causes the opening and closing valve control means 57 to open the opening and closing valve 6 of the activated indoor unit, and then causes the indoor degree-of-superheat control means 56 to set the opening degree of the flow control valve 4. For example, after a specific time has passed since opening of the opening and closing valve 6, the opening degree of the flow control valve 4 is set. Accordingly, in the transition time in which the refrigerant flow amount is not stable, occurrence of refrigerant flow noise can be suppressed by circulating the refrigerant in the expansion mechanism 10.

Furthermore, in order to activate a stopped indoor unit 2, the controller 50 causes the indoor degree-of-superheat control means 56 to control the opening degree of the flow control valve 4 and causes the opening and closing valve control means 57 to control opening and closing of the opening and closing valve 6, and then causes the indoor heat exchange amount control means 55 to start the rotating operation of the indoor fan 61. Accordingly, cold air can be blown from the indoor unit 2 in the state in which the temperature of refrigerant flowing in the indoor heat exchanger 3 is sufficiently reduced.

[Partial load at the time of heating operation]

Partial load at the time of heating operation will now be explained.

The number of indoor units 2 in operation and the amount of refrigerant flowing in each of the indoor units 2 decrease as indoor load decreases. Furthermore, the rotation speed of the indoor fan 61 decreases as the indoor load decreases, thereby decreasing the amount of heat exchange in the indoor heat exchanger 3. Therefore, the refrigerant turns into the two-phase gas-liquid refrigerant at the outlet of the indoor heat exchanger 3 without sufficient heat exchange.

When the two-phase gas-liquid refrigerant generated at the outlet of the indoor heat exchanger 3 enters the flow control valve 4, refrigerant flow noise may occur.

Thus, in the case where indoor load is small, the indoor degree-of-subcooling control means 58 sets the opening degree of the flow control valve 4 to be small. In this embodiment, in the case where the opening degree of the flow control valve 4 is small (for example, smaller than a specific opening degree), the opening and closing valve 6 is opened. Thus, a larger amount of refrigerant flows toward the expansion mechanism 10 in which the flow resistance is small.

When the refrigerant flows toward the expansion mechanism 10, similar to the case of cooling partial load, an effect of suppressing refrigerant flow noise can be achieved.

That is, at the time of heating operation in this embodiment, the two-phase gas-liquid refrigerant flows into the expansion mechanism 10 and passes through innumerable minute air holes of the inlet-side porous body 13, thereby turning vapor slugs (large bubbles) into small bubbles. Therefore, the refrigerant enters a homogeneous two-phase gas-liquid flow state (state in which a vapor refrigerant and liquid refrigerant are mixed sufficiently). Thus, the vapor refrigerant and the liquid refrigerant pass through the orifice 12 at the same time, and no change occurs in refrigerant velocity or pressure.

Furthermore, in the case of a porous transmitting material such as the inlet-side porous body 13, the inner passage is configured in a complicated manner, in which pressure fluctuations occur repeatedly, and has an effect of causing pressure fluctuation to remain constant while performing partial conversion into thermal energy. Thus, an effect of absorbing pressure fluctuations occurring in the orifice 12 can be achieved, thereby transmitting less influence on an upstream portion.

Furthermore, the flow velocity of refrigerant inside the high-speed two-phase gas-liquid jet flow at downstream of the orifice 12 is sufficiently reduced by the outlet-side porous body 14, thereby uniformizing the velocity distribution. Thus, the high-speed two-phase gas-liquid jet flow does not collide against the wall surface or no large eddies occur in the flow, resulting in a decrease in jet flow noise (refrigerant flow noise).

As described above, even in the case where two two-phase gas-liquid refrigerant is supplied to the indoor units 2, refrigerant flow noise can be suppressed.

Furthermore, in the case where indoor load is small at the time of heating operation or in accordance with a user operation, the controller 50 causes the operation of one or more of the plurality of indoor units 2 to stop and causes the other indoor unit(s) 2 to operate. The controller 50 causes the indoor degree-of-subcooling control means 58 of the stopped indoor unit 2 to fully close the flow control valve 4 and causes the opening and closing valve control means 57 to open the opening and closing valve 6.

Here, in the case where the operation of one or more of the indoor units 2 is stopped and the other indoor unit(s) 2 is/are caused to operate, since the compressor 31 is in an operating state, the refrigerant may retain inside the indoor heat exchanger 3 when the flow control valve 4 of the stopped indoor unit 2 is fully closed. Thus, even for the stopped indoor unit 2, a minute amount of refrigerant needs to flow in the indoor heat exchanger 3. In this embodiment, as described above, since the opening and closing valve 6 is opened so that the refrigerant circulates in the expansion mechanism 10, retaining of refrigerant inside the indoor heat exchanger 3 of the stopped indoor unit 2 can be suppressed.

Furthermore, although refrigerant flow noise is the main factor of indoor noise since the indoor fan 61 of the stopped indoor unit 2 is stopped, by circulating the refrigerant in the expansion mechanism 10 having porous bodies, refrigerant flow noise can be suppressed. As described above, since there is no need to take measures to decrease the flow resistance for the expansion mechanism 10 in this embodiment, the flow resistance can be increased to an extent at which a minute amount of flow necessary for suppressing retaining of refrigerant inside the indoor heat exchanger 3 is achieved.

Furthermore, in order to stop an indoor unit 2 in operation, the controller 50 causes the indoor unit 2 to stop by causing the indoor heat exchange amount control means 55 to set the rotation speed of the indoor fan 61 to zero. Then, the controller 50 causes the indoor degree-of-subcooling control means 58 to control the opening degree of the flow control valve 4 and causes the opening and closing valve control means 57 to control opening and closing of the opening and closing valve 6. Thus, in the case where the indoor unit 2 is stopped due to a decrease in indoor load or in the case where a stop operation is performed since the user determines that it is too cold, cold air is not supplied into the room and thus the comfortability is maintained. Furthermore, in order to stop the indoor unit 2, the opening degree of the flow control valve 4 is narrowed by the indoor degree-of-superheat control means 56 and the flow control valve 4 is eventually fully closed. In this transition time, when the opening degree of the flow control valve 4 decreases, the opening and closing valve 6 is opened, thus circulating the refrigerant in the expansion mechanism 10 having porous bodies. Therefore, refrigerant flow noise can be suppressed.

In the case where indoor load increases or in the case where a stopped indoor unit 2 is activated in accordance with a user operation, the controller 50 causes the opening and closing valve control means 57 to open the opening and closing valve 6 of the activated indoor unit, and then causes the indoor degree-of-superheat control means 56 to set the opening degree of the flow control valve 4. For example, after a specific time has passed since opening of the opening and closing valve 6, the opening degree of the flow control valve 4 is set. Accordingly, in the transition time in which the refrigerant flow amount is not stable, occurrence of refrigerant flow noise can be suppressed by circulating the refrigerant in the expansion mechanism 10.

Furthermore, in the case where a stopped indoor unit 2 is activated, the controller 50 causes the indoor degree-of-superheat control means 56 to control the opening degree of the flow control valve 4 and causes the opening and closing valve control means 57 to control opening and closing of the opening and closing valve 6. Then, the controller 50 causes the indoor heat exchange amount control means 55 to start the rotating operation of the indoor fan 61. Accordingly, cold air can be blown from the indoor unit 2 in the state in which the temperature of refrigerant flowing in the indoor heat exchanger 3 is sufficiently reduced.

As described above, in this embodiment, the opening and closing valve 6 is opened when the opening degree of the flow control valve 4 is greater than a fully-closed state and is smaller than a specific opening degree, and the opening and closing valve 6 is closed when the opening degree of the flow control valve 4 is equal to or greater than the specific opening degree.

Thus, in the case where the refrigerant flow amount is large, the refrigerant does not circulate in the expansion mechanism 10, thereby reducing the chances of a porous body of the expansion mechanism 10 to capture foreign substances. That is, in this embodiment, the lifetime total flow amount of refrigerant passing thorough a porous body is sufficiently small compared to the case where refrigerant always passes through a porous body as in a related art, thus a reduction in the reliability, such as clogging with a foreign substance, being avoided. Therefore, a large flow amount can be handled and long-time reliability can be ensured.

Furthermore, in the case where refrigerant flow amount is large, since refrigerant does not circulate in the expansion mechanism 10, there is no need to take measures to decrease the flow resistance in the expansion mechanism 10. Thus, by only setting the flow resistance in the expansion mechanism 10 in accordance with the low load time, miniaturization of the expansion mechanism 10 and space saving can be achieved. Moreover, a reduction in the cost can also be achieved. For example, a reheat dehumidification valve for a room air-conditioner can be directly mounted in the indoor units 2, thus achieving space saving. Therefore, since the reheat dehumidification valve is a component of room air-conditioners of a large production scale, a reduction in the cost can be achieved.

Furthermore, for example, in the case where the opening degree of the flow control valve 4 is large due to large indoor load, such as the rated load or peak load, the rotation speed of the indoor fan 61 is also large. The refrigerant flow noise of the flow control valve 4 is relatively small compared to noise caused by driving of the indoor fan 61. Thus, even if the refrigerant circulates in the flow control valve 4, refrigerant flow noise is not the main factor of noise of the indoor unit.

Furthermore, for example, in the case where the opening degree of the flow control valve 4 is small due to a reduction of indoor load or the like, although the rotation speed of the indoor fan 61 is also small and refrigerant flow noise is the main factor of indoor noise, by opening the opening and closing valve 6 to circulate the refrigerant in the expansion mechanism 10 having porous bodies, refrigerant flow noise can be suppressed.

Furthermore, in this embodiment, since the opening and closing valve 6 and the expansion mechanism 10 having porous bodies are connected in series with each other, in parallel to the flow control valve 4, even if the two-phase gas-liquid refrigerant circulates in the indoor unit 2, the refrigerant is rectified, thereby suppressing refrigerant flow noise.

Furthermore, in this embodiment, during the heating operation, in the case where the operation of one or more of the plurality of indoor units 2 is stopped and the other indoor unit(s) 2 is/are caused to operate, the flow control valve 4 of the stopped indoor unit 2 is fully closed and the opening and closing valve 6 of the indoor unit 2 is opened.

Thus, even in the case where the one or more indoor units 2 perform the heating operation and the compressor 31 is in an operating state, retaining of refrigerant inside the indoor heat exchanger 3 of the stopped indoor unit 2 can be suppressed. Furthermore, since the indoor fan 61 of the stopped indoor unit 2 is stopped, although refrigerant flow noise is the main factor of indoor noise, refrigerant flow noise can be suppressed by circulating the refrigerant in the expansion mechanism 10 having porous bodies.

Furthermore, in this embodiment, during the cooling operation, in the case where the operation of one or more of the plurality of indoor units 2 is stopped and the other indoor unit(s) 2 is/are caused to operate, the flow control valve 4 of the stopped indoor unit 2 is fully closed, and the opening and closing valve 6 of the stopped indoor unit 2 is closed. In the case where the stopped indoor unit 2 is caused to operate, after opening the opening and closing valve 6 of the indoor unit 2, the opening degree of the flow control valve 4 is set.

Thus, in the transition time in which refrigerant flow noise is likely to occur and the refrigerant flow amount fluctuates, occurrence of refrigerant flow noise can be suppressed by circulating the refrigerant in the expansion mechanism 10.

Furthermore, in this embodiment, in order to stop a indoor unit 2 in operation, after stopping the operation of the indoor fan 61 of the indoor unit 2, the operation of the flow control valve 4 and the opening and closing valve 6 is controlled.

Thus, the indoor fan 61 does not continue to operate after the operation in the refrigerant circuit is stopped, and cold air or warm air does not continue to be supplied into the room, thereby maintaining the comfortability. Furthermore, in the case where an indoor unit 2 is stopped, when the opening degree of the flow control valve 4 decreases in the transition time in which the flow control valve 4 becomes fully closed, the opening and closing valve 6 is opened. Thus, the refrigerant circulates in the expansion mechanism 10 having porous bodies. Therefore, even in the case where the indoor fan 61 is stopped and refrigerant flow noise is the main factor of indoor noise, since refrigerant circulates in the expansion mechanism 10 having porous bodies, refrigerant flow noise can be suppressed.

Furthermore, in this embodiment, in the case where a stopped indoor unit 2 is caused to operate, after controlling the operation of the flow control valve 4 and the opening and closing valve 6 of the indoor unit 2, the operation of the indoor fan 61 is started.

Thus, cold air or warm air can be blown from the indoor unit 2 in the state in which the temperature of refrigerant circulating in the indoor heat exchanger 3 is sufficiently low or sufficiently high. Therefore, air at a desired temperature can be blown from the indoor unit 2, thereby maintaining the comfortability.

As described above, an air-conditioning apparatus according to this embodiment has advantages of suppressing refrigerant flow noise, achieving low cost and space saving even when a large flow amount is assumed, and ensuring high reliability, in the case where the refrigerant flow noise is the main factor of noise of the indoor unit 2.

Although a porous body which is a porous transmitting material and is made from so-called foam metal has been explained in this embodiment, the present invention is not limited to this. Any material such as sintered metal, metal non-woven fabric, punching metal, or the like may be used as a porous body as long as it has a large number of holes.

REFERENCE SIGNS LIST

1: air-conditioning apparatus, 2: indoor unit, 3: indoor heat exchanger, 4: flow control valve, 6: opening and closing valve, 10: expansion mechanism, 10*a*: orifice structure, 11: orifice carrier, 12: orifice, 13: inlet-side porous body, 14: outlet-side porous body, 15: caulking part, 16: space, 16*a*: length, 17: space, 17*a*: length, 21: subcooling regulating valve, 26: copper pipe, 27: end portion, 28: end portion, 30: outdoor unit, 31: compressor, 32: oil separator, 33: four-way valve, 34: outdoor heat exchanger, 35: subcooling heat exchanger, 36: outdoor flow control valve, 37: liquid main pipe, 38: connection point, 39: liquid branch pipe, 40: gas branch pipe, 41: connection point, 42: gas main pipe, 43: accumulator, 43*a*: letter-shaped pipe, 43*b*: oil-return hole, 44: subcooling bypass path, 45: subcooling regulating valve, 46: oil-return path, 46*a*: pressure sensor, 47: capillary tube, 47*b*: pressure sensor, 48*c*: pressure sensor, 49*a*: temperature sensor, 49*b*: temperature sensor, 49*c*: temperature sensor, 49*d*: temperature sensor, 49*e*: temperature sensor, 49*f*: temperature sensor, 49*h*: temperature sensor, 49*j*: temperature sensor, 49*k*: temperature sensor, 50: controller, 51: compressor control means, 52: outdoor heat exchange amount control means, 53: subcooling heat exchanger degree-of-superheat control means, 54: outdoor expansion control means, 55: indoor heat exchange amount control means, 56: indoor degree-of-superheat control means, 57: opening and closing valve control means, 58: indoor degree-of-subcooling control means, 60: outdoor fan, 61: indoor fan

The invention claimed is:

1. An air-conditioning apparatus, comprising:

a refrigerant circuit including, an outdoor unit having a compressor and an outdoor heat exchanger, and a plurality of indoor units each having an expansion valve capable of varying an opening degree and an indoor heat exchanger, the refrigerant circuit connecting the outdoor unit and the plurality of indoor units with refrigerant pipes;

a controller configured to control operations of the compressor, the expansion valve, and an indoor fan provided in each of the indoor units;

an opening and closing valve configured to open and close a refrigerant passage; and an expansion mechanism having porous bodies capable of passing a refrigerant therethrough, wherein the opening and closing valve and the expansion mechanism are connected in series, while the serially connected opening and closing valve and the expansion mechanism are connected in parallel with the expansion valve, in a heating mode in which the refrigerant of high-temperature from the compressor is supplied to the indoor heat exchanger, in a case where the controller stops an operation of at least one of the plurality of indoor units and causes at least one of the indoor units to operate, the controller closes the expansion valve and opens the opening and closing valve of the stopped indoor unit, respectively, and the controller opens the opening and closing valve when the opening degree of the expansion valve is greater than a fully-closed state and is smaller than a specific opening degree, and closes the opening and closing valve when the opening degree of the expansion valve is equal to or greater than the specific opening degree.

2. The air-conditioning apparatus of claim 1, wherein in a cooling mode in which the refrigerant of low-temperature is supplied to the indoor heat exchanger, in a case where the controller stops an operation of at least one of the plurality of indoor units and causes at least one of the indoor units to operate, the controller closes the expansion valve and closes the opening and closing valve of the stopped indoor unit, respectively, and wherein in a case where the controller causes the stopped indoor unit to operate, the controller opens the opening and closing valve of the operated indoor unit and then sets the opening degree of the expansion valve of the operated indoor unit.

3. The air-conditioning apparatus of claim 1, wherein in a case where the controller causes an indoor unit in operation to be stopped, the controller stops an operation of the indoor fan of the indoor unit and then controls operations of the expansion valve and the opening and closing valve.

4. The air-conditioning apparatus of claim 1, wherein in a case where the controller causes an indoor unit being stopped to operate, the controller controls the operations of the expansion valve and the opening and closing valve of the indoor unit and then causes the indoor fan to start operation.

5. The air-conditioning apparatus of claim 1, wherein the specific opening degree is an opening degree at which a flow resistance of the refrigerant passing through the expansion valve is equal to a flow resistance in the expansion mechanism connected in parallel to the expansion valve.

6. The air-conditioning apparatus of claim 1, wherein the expansion mechanism includes an orifice that is sandwiched between the porous bodies provided on an inlet side and an outlet side with respect to a refrigerant flow direction, and spaces are formed between the orifice and each of the porous bodies, wherein length in the refrigerant flow direction of one of the spaces formed between the porous body on the inlet side of the refrigerant flow in the heating mode and the orifice is smaller than or equal to diameter of the orifice, and wherein length in a refrigerant flow direction of one of the spaces formed between the porous body on the outlet side of the refrigerant flow in the heating mode and the orifice is equal to or greater than the diameter of the orifice.

7. An air-conditioning apparatus comprising:

a refrigerant circuit including, an outdoor unit having a compressor and an outdoor heat exchanger, and a plurality of indoor units each having an expansion valve capable of varying an opening degree and an indoor heat exchanger; the refrigerant circuit connecting the compressor, the outdoor heat exchanger, the expansion valve, and the indoor heat exchanger with refrigerant pipes through which a refrigerant circulates, a controller configured to control at least the opening degree of the expansion valve, an opening and closing valve configured to open and close a refrigerant passage and an expansion mechanism having porous bodies capable of passing a refrigerant therethrough, wherein, in the refrigerant circuit, the opening and closing valve and the expansion mechanism are connected in series, while the serially connected opening and closing valve and the expansion mechanism are connected in parallel with the expansion valve, and wherein the controller opens the opening and closing valve when the opening degree of the expansion valve is greater than a fully-closed state and is smaller than a specific opening degree, and closes the opening and closing valve when the opening degree of the expansion valve is equal to or greater than the specific opening degree.

8. The air-conditioning apparatus of claim 7, wherein the specific opening degree is an opening degree at which a flow resistance of the refrigerant passing through the expansion valve is equal to a flow resistance in the expansion mechanism.

9. The air-conditioning apparatus of claim 7, further comprising a heat medium transmission device configured to transmit a heat medium that exchanges heat with the refrigerant in the indoor heat exchanger, wherein in a case where the refrigerant is caused to start flowing in the indoor heat exchanger, the controller causes the heat medium transmission device to start operation after the controller controls operations of the expansion valve and the opening and closing valve, respectively.

10. The air-conditioning apparatus of claim 7, further comprising a heat medium transmission device configured to transmit a heat medium that exchanges heat with the refrigerant in the indoor heat exchanger, wherein in a case where the refrigerant is caused to stop flowing in the refrigerant circuit, the controller controls respective operations of the expansion valve and the opening and closing valve after the controller causes the heat medium transmission device to stop an operation.

11. The air-conditioning apparatus of claim 7, wherein the indoor unit comprises a plurality of indoor units, and wherein in a heating mode in which the refrigerant of high-temperature from the compressor is supplied to the indoor heat exchanger, in a case where the controller stops an operation of at least one of the plurality of indoor units and causes at least one of the indoor units to operate, the controller closes the expansion valve and opens the opening and closing valve of the stopped indoor unit, respectively.

12. The air-conditioning apparatus of claim 7, wherein the indoor unit comprises a plurality of indoor units, wherein in a cooling mode in which the refrigerant of low-temperature is supplied to the indoor heat exchanger, in a case where the controller stops an operation of at least one of the plurality of indoor units and causes at least one of the indoor units to operate, the controller closes the expansion valve and closes the opening and closing valve of the stopped indoor unit, respectively, and wherein in a case where the controller causes the stopped indoor unit to operate, the controller opens the opening and closing valve of the operated indoor unit and then sets the opening degree of the expansion valve of the operated indoor unit.

* * * * *